US008671577B2

(12) United States Patent
Brown

(10) Patent No.: US 8,671,577 B2
(45) Date of Patent: Mar. 18, 2014

(54) RAZOR WITH INDEPENDENT SUSPENSION

(75) Inventor: Thomas Brown, Fairfield, IA (US)

(73) Assignee: Thomas A. Brown, Fairfield, IA (US)

( * ) Notice: Subject to any disclaimer, the term of this patent is extended or adjusted under 35 U.S.C. 154(b) by 524 days.

(21) Appl. No.: 12/573,033

(22) Filed: Oct. 2, 2009

(65) Prior Publication Data

US 2010/0132204 A1 Jun. 3, 2010

Related U.S. Application Data

(60) Provisional application No. 61/119,630, filed on Dec. 3, 2008, provisional application No. 61/147,936, filed on Jan. 28, 2009.

(51) Int. Cl.
*B26B 21/00* (2006.01)

(52) U.S. Cl.
USPC ..... 30/50; 30/526; 30/532

(58) Field of Classification Search
USPC ..... 30/47, 50, 63, 526–536
See application file for complete search history.

(56) References Cited

U.S. PATENT DOCUMENTS

| | | | | | |
|---|---|---|---|---|---|
| 890,406 | A | * | 6/1908 | Cobb | 30/526 |
| 935,979 | A | * | 10/1909 | Hauser et al. | 30/535 |
| 949,255 | A | * | 2/1910 | Bals | 30/526 |
| 1,015,575 | A | * | 1/1912 | Meyer | 30/527 |
| 1,247,581 | A | * | 11/1917 | Seitz | 30/531 |
| 1,403,936 | A | * | 1/1922 | Behrman | 30/57 |
| 1,423,414 | A | * | 7/1922 | Glaser | 30/534 |
| 1,639,441 | A | * | 8/1927 | Spahr | 30/529 |
| 1,719,675 | A | * | 7/1929 | Sirch | 30/526 |
| 1,767,705 | A | * | 6/1930 | Schick | 30/536 |
| 1,767,707 | A | * | 6/1930 | Schick | 30/536 |
| 2,059,172 | A | * | 10/1936 | Sabiers | 30/527 |
| 2,235,841 | A | * | 3/1941 | Monnet | 30/526 |
| 2,844,870 | A | * | 7/1958 | Roces et al. | 30/526 |
| 3,061,926 | A | * | 11/1962 | Fjeran | 30/526 |
| 3,283,403 | A | * | 11/1966 | Chambers | 30/526 |
| 3,299,509 | A | * | 1/1967 | Kuhnl | 30/526 |
| 3,396,464 | A | * | 8/1968 | Treiss | 30/531 |
| 3,685,150 | A | * | 8/1972 | Risher | 30/527 |
| 3,950,848 | A | * | 4/1976 | Goldstein | 30/531 |
| 4,266,340 | A | * | 5/1981 | Bowman | 30/532 |
| 4,332,321 | A | * | 6/1982 | Wratschko | 30/536 |
| 4,347,663 | A | * | 9/1982 | Ullmo | 30/527 |
| 4,720,917 | A | | 1/1988 | Solow | |
| 4,754,548 | A | | 7/1988 | Solow | |
| 4,797,998 | A | * | 1/1989 | Motta | 30/530 |

(Continued)

FOREIGN PATENT DOCUMENTS

| | | | |
|---|---|---|---|
| WO | 89-01394 | A1 | 2/1989 |
| WO | 94-08762 | A1 | 4/1994 |
| WO | WO 01/39937 | A1 | 6/2001 |

*Primary Examiner* — Jason Daniel Prone
(74) *Attorney, Agent, or Firm* — Schwabe, Williamson & Wyatt

(57) ABSTRACT

Embodiments of the present invention provide a handheld shaving apparatus with a razor head coupled to a body of the apparatus and employing an independent suspension system, which allows the user to maintain control of the razor head while also allowing the head to move in a generally linear fashion to accommodate surface features and imperfections. Further embodiments provide a handheld shaving apparatus with a razor head and body that collectively include one or more biasing mechanisms that permit the razor head to move in an axial and/or generally linear direction while resisting substantial lateral movement of the razor head, reducing the potential for lateral slicing by the razors.

18 Claims, 8 Drawing Sheets

(56) References Cited

U.S. PATENT DOCUMENTS

| | | | | | |
|---|---|---|---|---|---|
| 5,016,352 | A * | 5/1991 | Metcalf | 30/532 |
| 5,029,391 | A | 7/1991 | Althaus et al. | |
| 5,038,472 | A * | 8/1991 | Iderosa | 30/527 |
| 5,050,301 | A * | 9/1991 | Apprille, Jr. | 30/529 |
| 5,157,834 | A * | 10/1992 | Chen et al. | 30/532 |
| 5,167,069 | A * | 12/1992 | Quinn | 30/527 |
| 5,206,995 | A * | 5/1993 | Min | 30/527 |
| 5,224,267 | A | 7/1993 | Simms et al. | |
| 5,347,717 | A * | 9/1994 | Ts'ai | 30/532 |
| 5,369,885 | A | 12/1994 | Ferraro | |
| 5,608,972 | A * | 3/1997 | Tsae-Chyn | 30/526 |
| 5,715,606 | A | 2/1998 | de Wolf et al. | |
| 5,787,594 | A * | 8/1998 | Estrada | 30/531 |
| 5,822,869 | A * | 10/1998 | Metcalf et al. | 30/526 |
| 5,855,071 | A * | 1/1999 | Apprille et al. | 30/532 |
| 5,953,825 | A | 9/1999 | Christman et al. | |
| 6,223,442 | B1 * | 5/2001 | Pina | 30/527 |
| 6,311,400 | B1 | 11/2001 | Hawes et al. | |
| 6,381,857 | B1 * | 5/2002 | Oldroyd | 30/527 |
| 6,425,184 | B1 * | 7/2002 | Min | 30/527 |
| 6,434,839 | B1 * | 8/2002 | Lee et al. | 30/532 |
| 6,615,498 | B1 | 9/2003 | King et al. | |
| 6,880,253 | B1 | 4/2005 | Gyllerstrom | |
| 6,973,730 | B2 * | 12/2005 | Tomassetti et al. | 30/527 |
| 7,024,776 | B2 * | 4/2006 | Wain | 30/527 |
| 7,103,976 | B2 * | 9/2006 | Pennella | 30/526 |
| 7,131,203 | B2 | 11/2006 | Wain | |
| 7,137,203 | B2 * | 11/2006 | Bressler et al. | 30/535 |
| 7,152,512 | B1 | 12/2006 | Prochaska | |
| 7,770,294 | B2 * | 8/2010 | Bruno et al. | 30/50 |
| 7,797,834 | B2 * | 9/2010 | Steunenberg et al. | 30/527 |
| 2003/0213130 | A1 * | 11/2003 | Motta | 30/50 |
| 2004/0020053 | A1 | 2/2004 | Wain | |
| 2004/0181953 | A1 * | 9/2004 | Follo et al. | 30/527 |
| 2005/0000100 | A1 * | 1/2005 | Coffin | 30/531 |
| 2006/0218804 | A1 * | 10/2006 | Noble et al. | 30/527 |
| 2008/0086899 | A1 * | 4/2008 | Gallagher | 30/526 |
| 2010/0043242 | A1 * | 2/2010 | Stevens | 30/527 |
| 2011/0023310 | A1 * | 2/2011 | Psimadas et al. | 30/526 |
| 2011/0167653 | A1 * | 7/2011 | Psimadas et al. | 30/526 |
| 2011/0197450 | A1 * | 8/2011 | Taub et al. | 30/50 |
| 2012/0073149 | A1 * | 3/2012 | Murgida et al. | 30/526 |
| 2012/0073150 | A1 * | 3/2012 | Murgida et al. | 30/532 |
| 2012/0096722 | A1 * | 4/2012 | Howell et al. | 30/531 |
| 2012/0096723 | A1 * | 4/2012 | Howell et al. | 30/531 |

* cited by examiner

RAZOR WITH INDEPENDENT SUSPENSION

CROSS REFERENCE TO RELATED APPLICATIONS

The present application claims priority to U.S. Provisional Patent Application No. 61/119,630 filed Dec. 3, 2008, entitled "Razor With Independent Suspension" and U.S. Provisional Patent Application No. 61/147,936 filed Jan. 28, 2009, entitled "Razor With Independent Suspension," the disclosures of which are hereby incorporated by reference in their entireties.

TECHNICAL FIELD

Embodiments of the present invention relate to razors and related shaving devices, and, more specifically, to a shaver having suspension disposed in the handle, the head, or both, and/or between the handle and the head to allow generally linear and/or axial movement of the head with respect to a portion of the handle.

BACKGROUND

Razors used for shaving one's face, legs, etc., have been around for years. Due to various imperfections of the shaving surface, cuts can be a common and annoying occurrence. To try and solve this problem, razors have utilized different spring functions such as a flexible head that allows for some movement of a central portion of the head to accommodate the imperfection. Not only do these not allow movement of the outer portions of the head, but the spring response in these types of heads is generally not sensitive enough to address the more subtle imperfections. Other attempts have been made where the head is coupled to the handle via a leaf spring which may allow movement of the head in X, Y, and Z directions. Such configurations are challenging to control and do not adequately maintain a cutting surface position during the shaving process. Finally, heads that pivot are also used, but have similar shortcoming as those described above. Accordingly, a system is needed that will accommodate imperfections yet allowing the user to maintain head control during the shaving process and minimize cuts due to imperfections and varying features.

BRIEF DESCRIPTION OF THE DRAWINGS

Embodiments of the present invention will be readily understood by the following detailed description in conjunction with the accompanying drawings. Embodiments of the invention are illustrated by way of example and not by way of limitation in the figures of the accompanying drawings.

DETAILED DESCRIPTION OF EMBODIMENTS OF THE INVENTION

Figure 1:
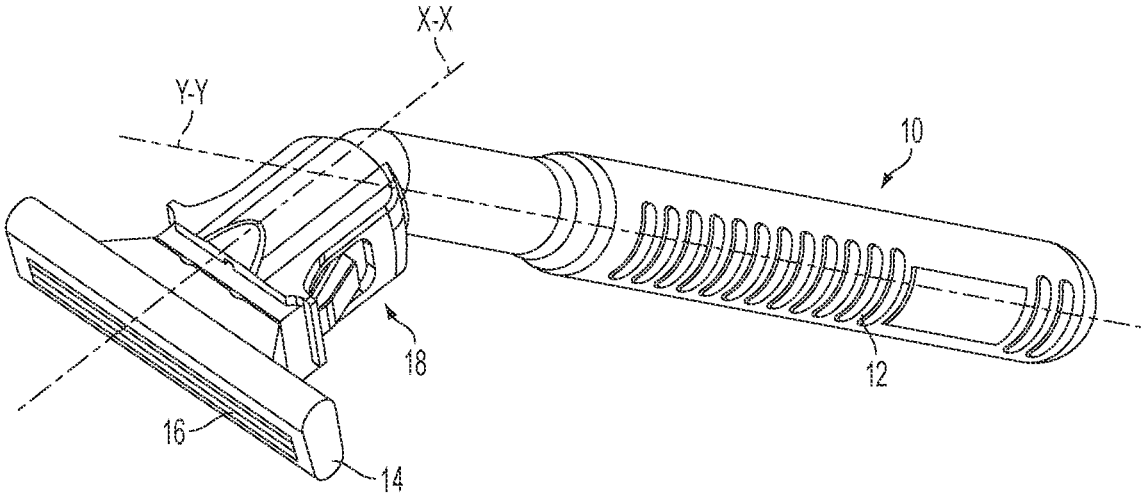
FIG. 1 illustrates a razor with an independent suspension system in accordance with various embodiments.

In the following detailed description, reference is made to the accompanying drawings which form a part hereof, and in which are shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, anterior/posterior, upper/lower and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

The description may use the phrases "head", "razor head" and/or "the head". These phrases are used herein with respect to components of embodiments, rather than with respect to anatomical features of the user. Where anatomical features of a user are discussed, phrases including the term "head" will be qualified as such (e.g. "the head of a user", "the user's head", etc.).

Embodiments of the present invention provide a handheld razor having a head coupled to the body of the razor and include an independent suspension system, which can allow the user to maintain control of the razor head while also allowing all or part of the head to move in a generally linear fashion to accommodate features and imperfections.

In one embodiment, as illustrated in the accompanying figures, a razor in accordance with various embodiments may comprise a handle and a replaceable head coupled to the shaft. Disposed within the shaft may be a biasing mechanism that allows for generally axial movement of the head with respect to a portion of the handle (see e.g. direction shown by arrow A, FIGS. 5*a* and 5*b*; axis X-X, FIGS. 1 and 2). Such embodiments may allow for the head to move in the axial or in a single linear direction and resist substantial lateral movement of the head with respect to the handle. In such embodiments, as a user pulls the razor across the surface of the skin and an imperfection or changing feature is encountered, the head may move in the A direction along the X-X axis yet without moving laterally. This can help avoid a slicing movement that may occur by lateral shifting of the head. In other embodiments, the suspension may be in the head itself and adapted to allow axial movement of the blades or blade bed.

FIG. 1 illustrates an embodiment of a razor that allows for axial movement of the razor head with respect to the handle, and in some instances, resistance to lateral movement. Razor 10 may include a handle 12 and a head 14 coupled thereto. Head 14 may include one or more razor blades 16 configured to shave hair close to the skin. Head 14 may be coupled to handle 12 via coupler 18, wherein coupler 18 may include a biasing component that can allow for axial movement along axis X-X with respect to the handle axis Y-Y.

In various embodiments, handle 12 may be solid, hollow, or solid in some portions and hollow in others. Handle 12, head 14, coupler 18 and/or any component thereof may be constructed of any suitable material known in the art, such as metal, a metal alloy, ceramic, a polymer, an elastomer and/or a plastic/polymer. In some embodiments, handle 12 may be removable and/or fold for travel/storage. In some embodiments, a head 14 may be coupled to handle 12 without a coupler 18, and one or more components described below for coupler 18 may instead be one or more components of a handle 12 and/or of a head 14.

Figure 2:
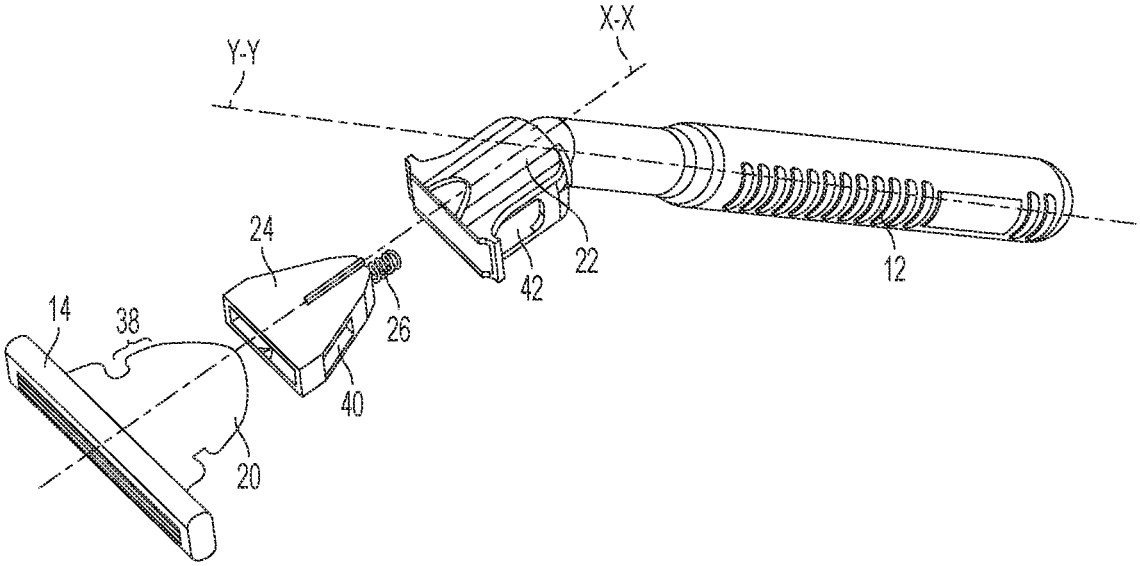
FIG. 2 illustrates an exploded view of a razor with an independent suspension system in accordance with various embodiments.

FIG. 2 illustrates a partially exploded view of the razor of FIG. 1. Handle 12 may have a receiver 22 adapted to receive an intermediate member 24 and/or a first member 20. In some embodiments, a first member 20 may be coupled to a head 14 and to an intermediate member 24. One or more of these components may be releasably coupled. First member 20 may also be configured to be coupled to receiver 22, with and/or without intermediate member 24. In one embodiment, intermediate member 24 may be adapted to receive first member 20 and couple to receiver 22. A first biasing member 26, such as a spring, may be disposed between the intermediate member 24 and the receiver 22 and/or the first member 20. In various embodiments, the first biasing member 26 may include a spring sized to engage a protrusion 44 (FIG. 3) on the intermediate member 24. In various embodiments, a variety of configurations may be employed to retain biasing member 26 with receiver 22 or intermediate member 24. In embodiments, a first biasing member 26 may be a rust-resistant stainless steel spring element.

In various embodiments, the first member 20 may have tabs 38 adapted to engage intermediate member slots 40 and/or corresponding receiver slots 42 of receiver 22. In various embodiments, the tabs 38 may be adapted to engage corresponding receiver slots 42 of receiver 22 to help couple the first member 20 to the receiver 22. Receiver slots 42 may be sized such that axial movement of the intermediate member 24 and thus head 14 may be permitted a desired distance as a result of the compression of first biasing member 26. Tabs 38 may also be adapted for use by the user in the coupling and uncoupling of head 14 to first member 20/intermediate member 24/receiver 22. In some embodiments, some or all of first member 20 may comprise a flexible or compressible material/component, and force applied to tabs 38 (e.g. by a user pressing one or more tabs 38 inward) may move distal portions of first member 20 inward, causing disengagement of first member 20 from head 14. Likewise, compression and/or movement of distal portions of intermediate member 20 may allow a user to position head 14 and first member 20 for engagement.

In various embodiments, the first member 20 may be directly connected to the receiver 22 without use of the intermediate member 24. In various embodiments, the handle 12 may include the first member 20, and the head 14 may be removably coupled to the first member 20. In various embodiments, the axial movement X-X may be at an angle with/to and generally intersect the handle axis Y-Y. In various embodiments, the axial movement X-X may be generally parallel with and/or co-axial with handle axis Y-Y.

Figure 3:
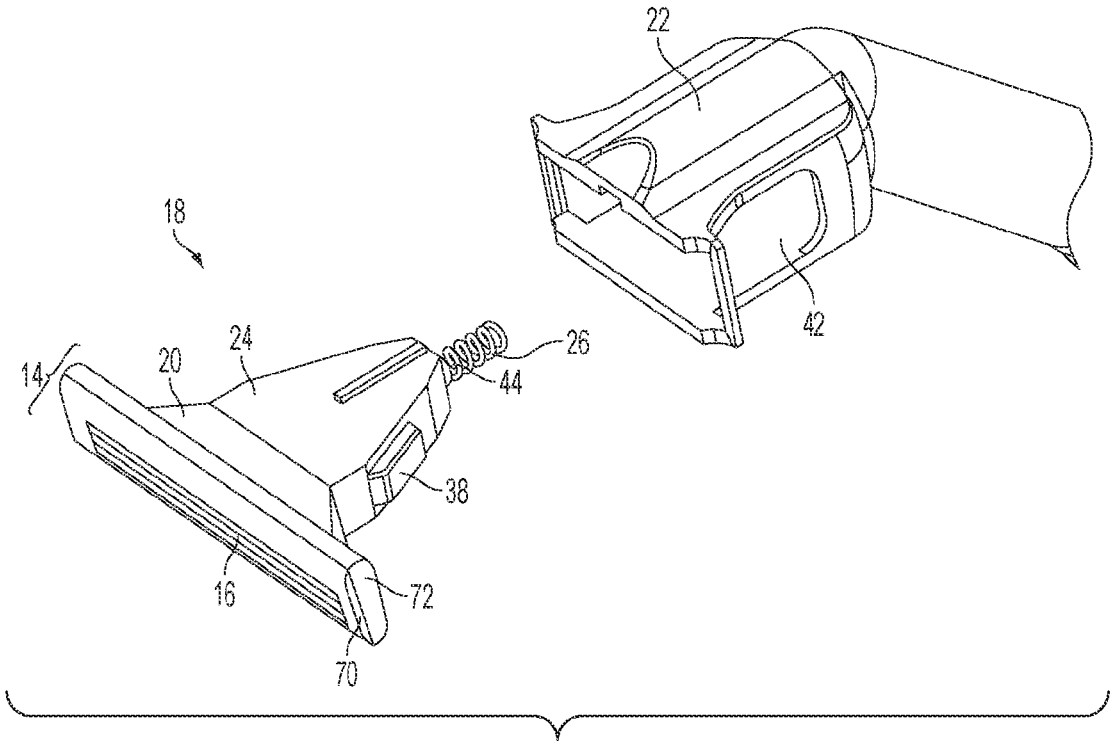
FIG. 3 illustrates a partially exploded view of a razor and a razor head with an independent suspension system in accordance with various embodiments.
Figure 4:
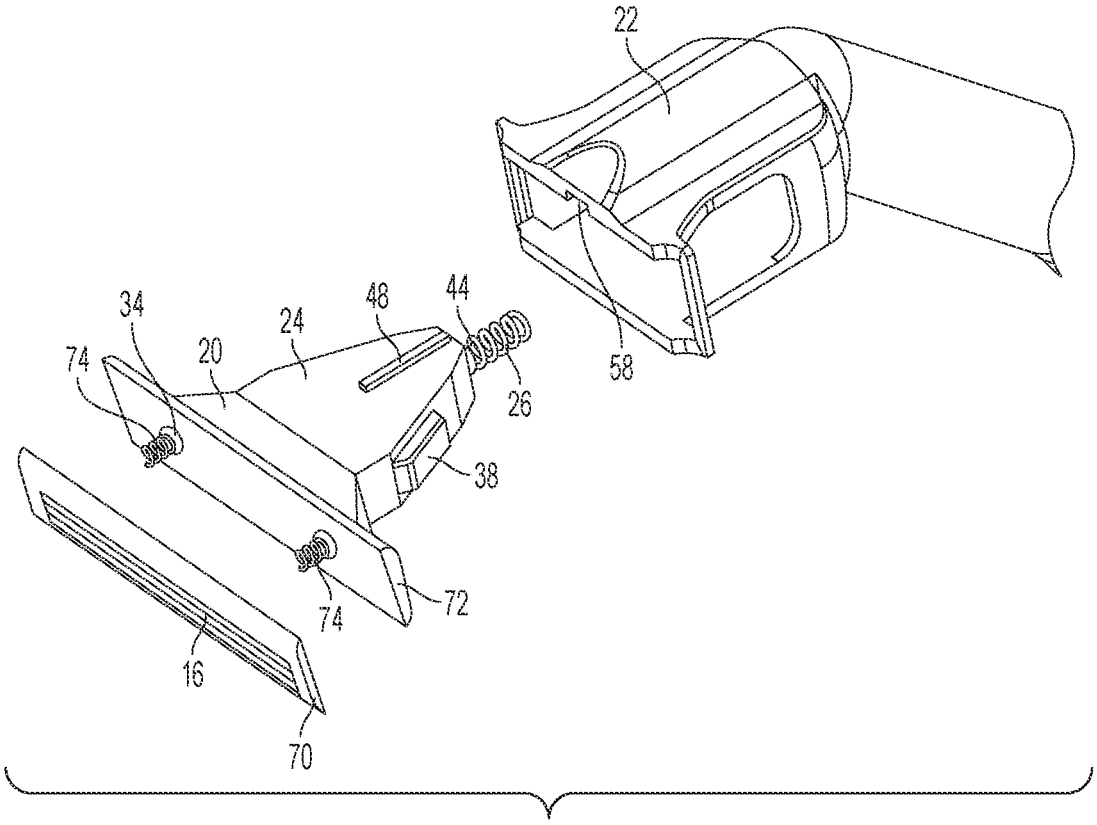
FIG. 4 illustrates a partially exploded view of a razor head with independent suspension in accordance with various embodiments.

FIGS. 3 and 4 illustrate a razor head with an independent suspension system in accordance with various embodiments of the present invention. FIG. 4 shows a partially exploded view of the embodiment shown in FIG. 3. As shown in FIG. 3, a coupler 18 may include one or more of first member 20, intermediate member 24, a protrusion 44, a first biasing member 26 and/or a razor head 14. A razor head 14 in accordance with various embodiments may comprise one or more blades 16 coupled to an anterior section 70, and anterior section 70 may be coupled to a posterior section 72. In some embodiments these sections may be coupled by various interior/exterior surface features and/or by mechanical fasteners known in the art. In embodiments, anterior section 70 and posterior section 72 may be mechanically coupled in a manner that limits lateral and/or shifting movement of the anterior section 70 with respect to posterior section 72 while permitting axial movement of the anterior section 70. One or more head biasing members 74 (see FIG. 4) may be disposed between anterior section 70 and posterior section 72 such that axial force directed against anterior section 70 compresses one or more head biasing members 74. In some embodiments, a first biasing member 26 and a head biasing member 74 may both be provided. Other embodiments may include two or more head biasing members 74, only first biasing member 26, or any number and combination of either/both.

Head biasing members 74 may be disposed between anterior section 70 and posterior section 72 in any suitable number and in any suitable arrangement. For example, embodiments may include one, two, three, four or more head biasing members 74, which may be positioned at or near the corners, at or near the center, along a center line, etc. Head biasing members 74 may comprise coiled spring members and/or leaf springs of rust-resistant stainless steel. In embodiments, a head biasing member 74 may be arranged within a razor head at opposite ends to provide differential compression of the spring members as a function of where the axial force is applied (e.g. force applied to one end of the anterior section of the head compresses the proximate spring to a greater degree than the distal spring), thus providing for additional protection against lateral slicing. In some embodiments, a head biasing member 74 may be accommodated and/or retained by a surface feature of anterior section 70 and/or posterior section 72, such as by a concavity 34 or by a protrusion such as protrusion 44.

In some embodiments, intermediate member 24 may include a guide ridge 48. Guide ridge 48 may be accommodated in embodiments by a corresponding guide ridge channel 58 of the receiver 22 to assist the user in coupling the components, to provide additional mechanical stability to the coupled components, and/or to prevent incorrect insertion of intermediate member 24 into receiver 22 (e.g. prevent upside-down insertion of intermediate member 24). In various embodiments, biasing members such as head biasing members 74 and/or first biasing member 26 may be disposed in various locations between the razor head and the body or handle. Further, the head may be removable from the handle and/or coupler body, such that waste may be minimized upon replacement, and yet axial movement of the blades within the replaceable head may still be accomplished.

Figure 5A:
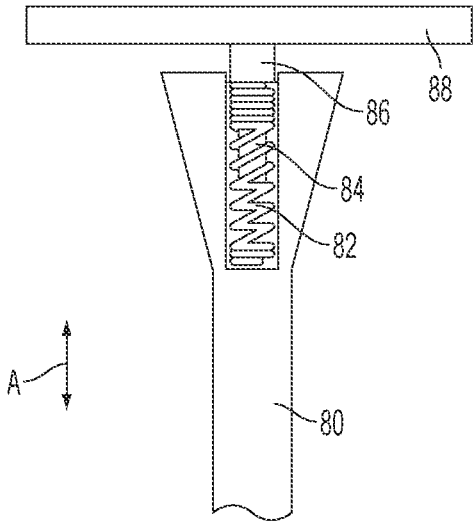
FIGS. 5*a* and 5*b* illustrate razors with an independent suspension system in accordance with various embodiments.
Figure 5B:
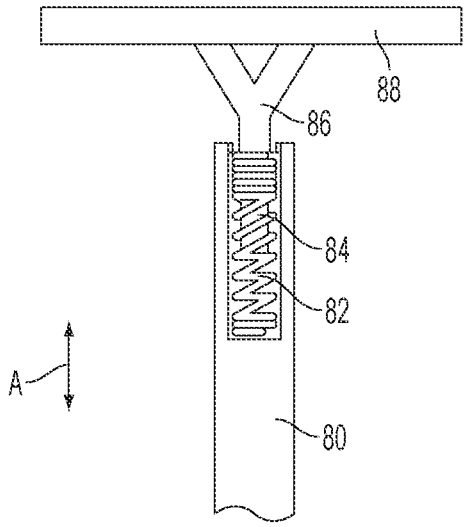

FIGS. 5*a* and 5*b* illustrate razors with an independent suspension system in accordance with various embodiments. Disposed within a shaft 80 may be a biasing mechanism which may include a spring member 82 in cooperation with a seat 84. The seat 84 may be coupled to the razor head 88 either directly or by an adaptor member 86. An adaptor member 86 and a razor head 88 may be constructed as a single unit and/or as two, three or more separable or inseparable units. In embodiments, such a biasing mechanism allows for generally axial movement of the razor head 88 with respect to a portion of the shaft 80 (see e.g. direction shown by arrow A, FIGS. 5*a* and 5*b*). Such embodiments may allow for the razor head 88 to move in an axial direction and/or in a single linear direction and to resist substantial lateral or shifting movement of the razor head 88 with respect to the shaft 80 (e.g. movement in a direction perpendicular to arrow A). In such embodiments, as a user pulls the razor across the surface of the skin and encounters an imperfection or changing feature, the head may move in the A direction, yet without moving laterally. This helps to prevent slicing movements that may occur by lateral shifting of the head.

Figure 6A:
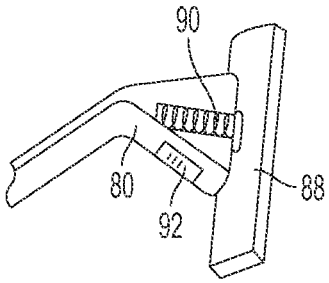
FIGS. 6*a*, 6*b*, 6*c* and 6*d* illustrate a razor with an independent suspension system in accordance with various embodiments.
Figure 6B:
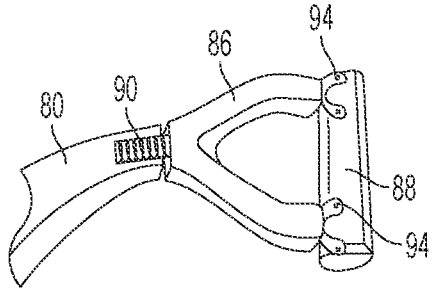
Figure 6C:
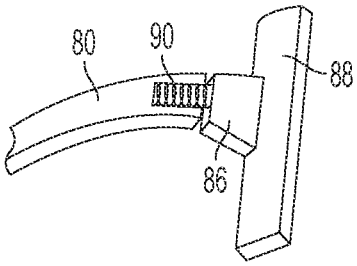
Figure 6D:
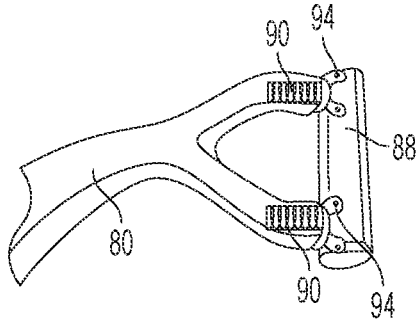

FIGS. 6*a*, 6*b*, 6*c* and 6*d* illustrate razors with independent suspension systems in accordance with various embodiments. In embodiments, the head 88 may be coupled to the razor handle 80 at one, two or multiple points (as illustrated in FIGS. 6*a*-6*d*), and each coupling may include a controlled biasing mechanism 90 allowing for generally axial movements of the head 88, as illustrated in FIGS. 5*a* and 5*b*. In some embodiments, the head 88 may be coupled to the razor handle 80 and/or to the biasing mechanism 90 via one, two, or more adaptor member(s) 86 and/or connecting members 94. In one embodiment, as illustrated in FIG. 6*d*, the head 88 may have two or more points of biased coupling with the handle 80. Providing a biasing mechanism 90 on each side may allow for one side of the head 88 to move axially to accommodate an imperfection whereas the other side may remain generally in the shaving plane to better accommodate anatomical features, surface variations and smaller offset imperfections. In some embodiments, a release member 92 may be provided for uncoupling head 88 from razor handle 80 and/or from biasing mechanism 90.

Figure 7:
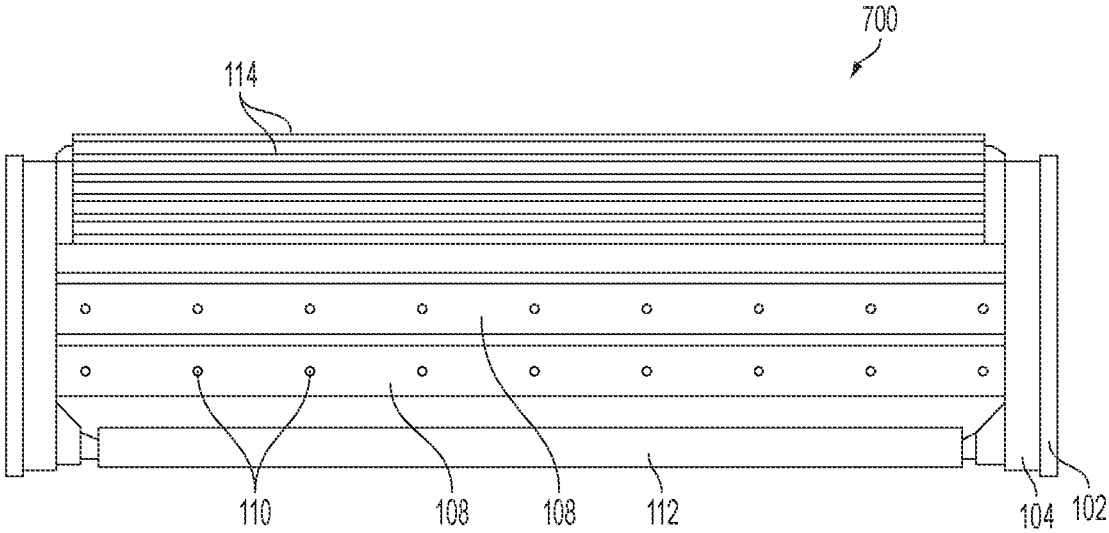
FIG. 7 illustrates an anterior view of a razor head in accordance with various embodiments.

FIG. 7 illustrates an anterior view of a razor head 700 in accordance with various embodiments of the present invention. A razor head 700 may include a frame 102 providing support for blades 108, a conditioning member 112, surface ridges 114, rivets 110 and one or more retaining elements 104. One, two, three or more blades 108 may be coupled to the anterior surface of frame 102 using a mechanical fastener such as rivets 110 or by other means known in the art. One or more retaining elements 104 may be disposed partially or completely around a portion of frame 102 and may retain one or more elements, such as blades 108, against the frame 102. Conditioning member 112 may be coupled to the anterior surface of frame 102 by an adhesive or other means known in the art. Some embodiments may lack a conditioning member 112. Surface ridges 114 may be coupled to frame 102 using adhesive, fasteners or other means, or may be formed as part of frame 102 in a single unit (e.g. during manufacturing). Surface ridges 114 may function to manipulate the skin of the user to minimize surface variations prior to the passage of the blades over the skin. Conditioning member 112 may comprise a gel, solid, or other composition suitable for soothing, smoothing and/or conditioning skin. As described above, components of razor head 700 may comprise any suitable materials known in the art, including but not limited to rust-resistant stainless steel, plastic, ceramic, metals and/or metal alloys, polymers, etc.

Figure 8:
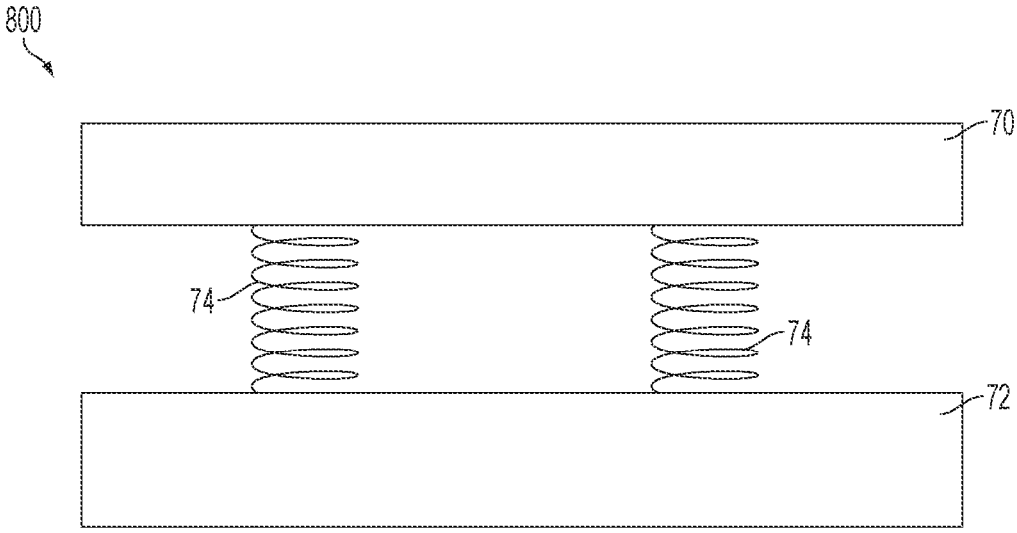
FIG. 8 illustrates a side view block drawing of a razor head with an independent suspension system in accordance with various embodiments.

FIG. 8 illustrates a side view block drawing of a replaceable razor head 800 with an independent suspension system in accordance with various embodiments. As described above with reference to FIGS. 3 and 4, a razor head 800 may include an anterior section 70 and a posterior section 72, with one or more spring members 74 disposed between them. The spring members 74 may be positioned to allow the razor head 800 to respond to unevenly applied axial forces with differential compression of the spring members 74, reducing lateral slicing injuries.

Figure 9A:
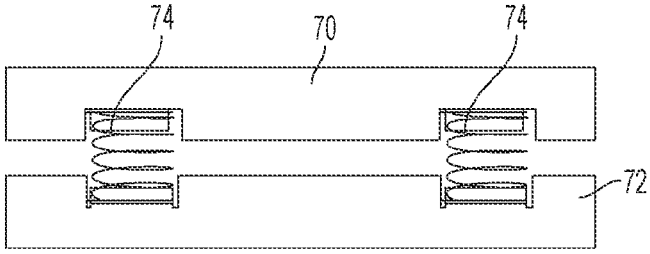
FIGS. 9*a*, 9*b*, 9*c* and 9*d* illustrate cutaway side views of a replaceable razor head with an independent suspension system in accordance with various embodiments.
Figure 9B:
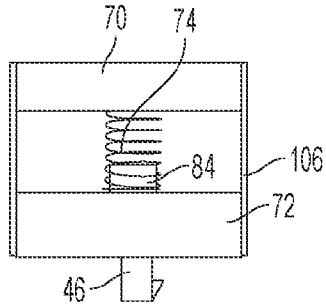
Figure 9C:
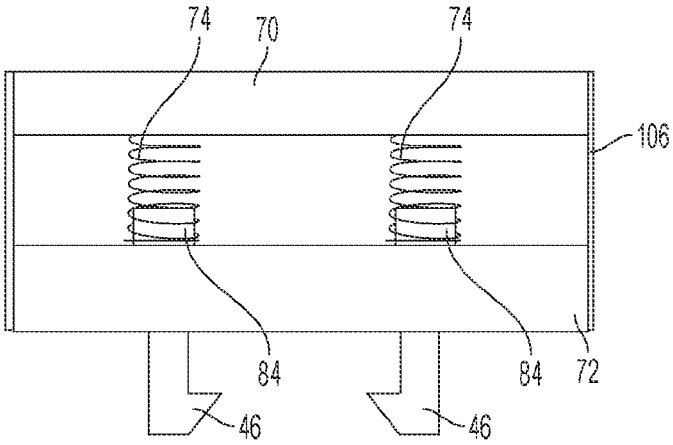
Figure 9D:
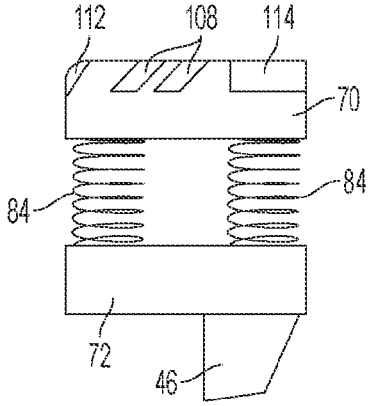

FIGS. 9*a*, 9*b*, 9*c* and 9*d* illustrate cutaway side views of various embodiments of a razor head 900 with a biasing mechanism. As shown in FIG. 9*a*, one or both of anterior section 70 and posterior section 72 may comprise one or more concavities or other surface features to accommodate an end of a spring member 74. Alternatively, in some embodiments such as those shown in FIGS. 9*b* and 9*c*, anterior section 70 and/or posterior section 72 may comprise a seat 84 to retain an end of a spring member 74. As shown in FIGS. 9*b*, 9*c* and 9*d*, posterior section 72 may comprise one or more retention elements 46 (e.g. compression fit hook couplers or other suitable features) for retaining one or more components of a shaving apparatus to the head 900. As shown in FIGS. 9*b* and 9*c*, anterior section 70 and posterior section 72 may be retained/coupled together by one or more lateral elements 106, which may be one or more separate elements and/or may be part of anterior section 70 and/or posterior section 72.

In various embodiments, the biasing mechanism may be a spring (such as the spring member 74, illustrated) or another resilient biasing device, such as a shock absorber. Using a shock absorber, the return of the head to the shaving plane after it is displaced by a feature imperfection may be dampened so that the response may be controlled. In various embodiments, a control rod may be disposed within the spring to help stabilize the head and resist lateral or non-axial movement of the head. In various embodiments the biasing members may be springs, elastomers, or other resilient members.

In various embodiments, the resilience of the biasing mechanism may be preset, while in other embodiments a user may adjust the resilience to suit the movement of the head according to shaving operation. In one embodiment, the tension of a spring, for example, may be adjusted by a dial or some other adjusting means that alters the spring constant. In other embodiments, the adjusting mechanism may influence the amount of resistance applied to a shock absorber as well as the amount of resilient force.

In some embodiments, a razor head with or without a biasing mechanism may be disposable and/or replaceable. In other embodiments, the razor head may be reusable and one or more other components may be disposable and/or replaceable. For example, in an embodiment, a handle 12 may be retained and other components (e.g. coupler 18 and/or razor head 14/88) may be disposable and/or replaceable. In some embodiments, razor head 14/88 and coupler 18 and/or components of coupler 18 may be replaceable individually and/or as a single unit. In various embodiments all components may be disposable and/or replaceable separately or in pre-assembled groups.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A shaving apparatus, comprising:

a handle defining an hollow portion fixed relative to the handle with a closed first end and an opposite second end with an opening, the hollow portion extending from the closed first end to the opening along a first axis;

a head with an anterior side and an opposite posterior side, the head comprising one or more razor blades disposed generally within a surface plane of the anterior side;

a coupler extending along the first axis and substantially perpendicular to said surface plane, a first end of the coupler connected to the posterior side of the head, and an opposite second end of the coupler disposed through the opening and received within the hollow portion; and a first biasing element disposed along said first axis between the anterior surface of the head and the closed first end of the hollow portion, the first biasing element being compressible in response to force applied against the anterior surface of the head, wherein compression of the first biasing element causes axial movement of the head toward the hollow portion along said first axis in a direction substantially perpendicular to said surface plane of the head.

2. The apparatus of claim 1, the coupler further comprising a first coupling element with a first diameter and a second coupling element with a second diameter, wherein the first diameter is greater than the second diameter.

3. The apparatus of claim 2, wherein the first biasing element is partially compressed between the first coupling element and the closed first end of the hollow portion.

4. The apparatus of claim 3, further including a second biasing element disposed within the head.

5. The apparatus of claim 1, the coupler further comprises coupling elements, wherein a first one of the coupling elements comprises a hollow portion for releasably retaining a second one of the coupling elements.

6. The apparatus of claim 1, wherein the posterior side of the head further comprises an adaptor portion configured to connect to the first end of the coupler.

7. The apparatus of claim 5, wherein the biasing element is disposed between the anterior section and the posterior section of the head to allow for axial movement of the blades.

8. The apparatus of claim 1, wherein the coupler further comprises a control feature for uncoupling the head from the second end of the coupler.

9. A reusable shaving apparatus comprising:

a handle comprising a handle first end with a coupling feature fixed relative to the handle the coupling feature having an interior concavity with a closed end and an opposite open end, and defining a center axis extending from the closed end to the open end;

a head assembly comprising one or more blades disposed generally within a surface plane of the head assembly;

an intermediate member configured to retain the head assembly, the intermediate member being disposed through the open end of the coupling feature and at least partially accommodated within the interior concavity of the coupling feature; and a biasing element disposed within the interior concavity of the coupling feature and coupled to the intermediate member in linear alignment such that the center axis extends through the biasing element and the intermediate member, wherein the coupling feature is configured to accommodate axial movement of the intermediate member and the biasing element within the interior concavity in a single linear direction substantially perpendicular to the surface plane of the head assembly, and to resist movement of the intermediate member in other directions.

10. The reusable shaving apparatus of claim 9, wherein the biasing element is partially compressed between a first end of the intermediate member and the coupling feature, and wherein the biasing element is further compressible to allow said axial movement of the intermediate member relative to the coupling feature.

11. The reusable shaving apparatus of claim 10, the intermediate member comprising an adaptor portion and a seat portion, the biasing element having a first end abutting the adaptor portion.

12. The reusable shaving apparatus of claim 11, the biasing element comprising a spring member with an interior void, a second end of the intermediate member opposite the first end movably disposed within the interior void.

13. The reusable shaving apparatus of claim 10, at least one of the intermediate member and the coupling feature further comprising one or more control features for unlocking the head assembly from the coupling feature.

14. The reusable shaving apparatus of claim 13, wherein the one or more control features comprises an aperture or a lateral protrusion.

15. The reusable shaving apparatus of claim 13, wherein at least one of the one or more control features is an aperture configured to accommodate a portion of a head assembly, the portion of the head assembly being accessible while coupled to the intermediate member.

16. The reusable shaving apparatus of claim 9, wherein the intermediate member includes a hollow portion open at one end, the intermediate member configured to releasably accommodate the head assembly at least partially within the hollow portion.

17. The reusable shaving apparatus of claim 9, wherein the intermediate member includes at least one exterior surface feature that mates to a corresponding feature of the interior concavity.

18. A shaving apparatus, comprising:

a handle defining a hollow portion with a closed first end, an opposite second end with a first opening, and at least one receiver slot between the first and second ends, the hollow portion extending from the closed first end to the opening along a first axis, the hollow portion fixed relative to the handle;

a head with an anterior side and an opposite posterior side, the head comprising one or more razor blades disposed generally within a surface plane of the anterior side;

a coupler extending along the first axis and substantially perpendicular to said surface plane, a first end of the coupler connected to the posterior side of the head, an opposite second end of the coupler disposed through the opening and received within the hollow portion, the coupler including at least one tab that is compressibly engagable with the at least one receiver slot; and a first biasing element disposed along said first axis between the anterior surface of the head and the closed first end of the hollow portion, the first biasing element being compressible in response to force applied against the anterior surface of the head, wherein compression of the first biasing element causes axial movement of the head toward the hollow portion along said first axis in a direction substantially perpendicular to said surface plane of the head.

* * * * *